United States Patent [19]

Adler

[11] 4,184,432

[45] Jan. 22, 1980

[54] HOPPER CAR DOOR LOCK MECHANISM

[75] Inventor: Franklin P. Adler, Michigan City, Ind.

[73] Assignee: Illinois Railway Equipment Company, Chicago, Ill.

[21] Appl. No.: 849,755

[22] Filed: Nov. 9, 1977

[51] Int. Cl.[2] ..... B61D 7/02; B61D 7/18; B61D 49/06; E05B 65/14

[52] U.S. Cl. ..... 105/248; 105/280; 105/308 R; 105/308 P

[58] Field of Search ..... 105/248, 280, 308 R, 105/308 A, 308 B, 308 C, 308 E, 308 P

[56] References Cited

U.S. PATENT DOCUMENTS

| | | | |
|---|---|---|---|
| 1,809,850 | 6/1931 | Hosceit | 105/308 R |
| 1,867,789 | 7/1932 | Wine et al. | 105/308 R |
| 2,294,502 | 9/1942 | Kadel | 105/308 R |
| 3,121,405 | 2/1964 | Smith | 105/308 P |
| 3,149,582 | 9/1964 | Madland | 105/308 P |

*Primary Examiner*—Joseph F. Peters, Jr.

*Assistant Examiner*—Howard Beltran

*Attorney, Agent, or Firm*—Lockwood, Dewey, Alex & Cummings

[57] ABSTRACT

A lock mechanism for a hopper door is provided which is especially suitable for use on railway hopper cars having hinged double doors. Included in the lock mechanism is a hook which is mounted on an outside hopper sheet and which is pivotable for engaging extensions of a spreader bar joining the double doors. The hook, being mounted through a slot therein, in addition to being pivotal is also slidable through a limited slaping path that is generally parallel to the floor of the hopper, such slidable action enabling the doors to be held at either a "catch" position or a fully closed position. The lock mechanism positively positions the doors with opening and closing operations. An especially secure lock, one which maintains door closure even when the railway car is rotated is attained when a latch having a spring-like projection holds each hook and thus the hopper doors in their fully closed positions.

11 Claims, 8 Drawing Figures

35
36
37
42
38
33
31
32
41
11
30
27
29
25
26
28
8
38
46
8
45
34
23
21
44
43
24
38
46
25

HOPPER CAR DOOR LOCK MECHANISM

BACKGROUND AND DESCRIPTION OF THE INVENTION

The present invention generally relates to a lock mechanism for a hopper door, more particularly to an improved lock mechanism for mounting on both of the two outside hopper sheets adjacent double doors of railway hopper cars to open adjacent double doors simultaneously. The particular double door lock mechanism of the present invention improves the operational aspects of conventional double door locking arrangements by including a hook member that is pivotable so as to hook and hold the chute doors while also being slidable so as to close and lock the chute doors.

Generally, railway hopper cars are constructed to be emptied through a plurality of adjacent double doors located on the underside of the car whereby the bulk of the contents within the hopper car may be discharged therefrom through said doors and into a collecting area located below the railway tracks. Usually, the hopper cars are constructed with two doors, one accessible from one side of the train of cars, and another accessible from the other side of the cars. Often, a spreader bar is added for joining these adjacent double hopper doors to ensure that neither one of the doors will open until lock mechanisms provided on both of the outside hopper sheets are unlocked.

Previously known double door lock mechanisms include a pivotable hook that is actually a double hook in that it has one small recess which engages the spreader extension to hold the doors in the "catch" position and one larger recess to hold the door in a fully closed position. Two workmen generally work together from opposite sides of the hopper cars and swing the open adjacent double doors from the fully opened position to the "catch" position by pushing with one foot on the spreader bar extensions. In the "catch" position, the doors are open a few inches at their bottoms. Each man next places a long pry bar, usually about 5 feet long and 1½ inch in diameter, through prying holes provided and then levers the doors to the fully closed position whereupon the larger recess on each hook drops into its working position. If the hook does not drop to the fully closed position, the workman hammers it there by using one end of his pry bar. Next, the workman moves a locking cam to the lock position and hammers it to the fully locked position with a hammer or an end of the pry bar. This type of locking cam arrangement has been found to fail on occasion when the entire hopper car is rotated for unloading.

To unlock this type of prior art double door lock, a workman drives the locking cam to the unlocked position and then drives the hook upwards to release the door. Sometimes the hook stays up momentarily, permitting the door to move to the fully opened position. At other times, the hook drops in time to hold the door in the "catch" position, in which case, the workman hammers the hook upwards to release the door. The hook is operated primarily by gravity, making the operation thereof somewhat dependent upon the particular orientation of the hopper car and the freedom with which the hook pivots about its pivot pin.

Another type of double door lock mechanism which attempts to improve upon the foregoing lock arrangement includes a lever, one end of which is attached to a spreader arm connecting the adjacent double doors, with the other end thereof being attached to a bell crank mounted on a shaft in such a manner that the lever, bell crank, and the shaft are in an overcenter relationship when the doors are closed. The operating shaft extends to each side of the car as does the locking shaft which operates locking cams, thereby permitting these mechanisms to be operated from either side of the car. However, these locking mechanisms are relatively expensive.

The present invention operates in a positive and sure manner when moving to the desired position, whether it be the fully closed, the "catch", or the fully opened position by providing a single-recess hook member that is both pivotable and slidable such that it pivots to properly locate the door as it moves from the fully opened position to the "catch" position or vice versa, while it also slides for movement between the "catch" position and the fully closed position. In the preferred embodiment, a latch is provided which is resistant to changes in gravitational forces brought about when the entire railway hopper car is rotated so that the hopper car doors will remain fully closed and locked even during such rotation.

It is, therefore, a general object of the present invention to provide an improved lock mechanism for a hopper door.

Another object of the present invention is to provide an improved double door lock mechanism for adjacent doors of a railway hopper car.

Another object of the present invention is to provide an improved double door hopper lock mechanism that operates in a positive and sure manner when moving to a desired position.

Another object of this invention is an improved lock mechanism for use on double doors of hopper railway cars that provides locking features independent of gravitational forces so as to maintain the locking engagements even when the railway cars are rotated.

These and other objects of the present invention will be apparent from the following detailed description of a preferred embodiment, taken in conjunction with the accompanying drawings wherein.

Figure 1:
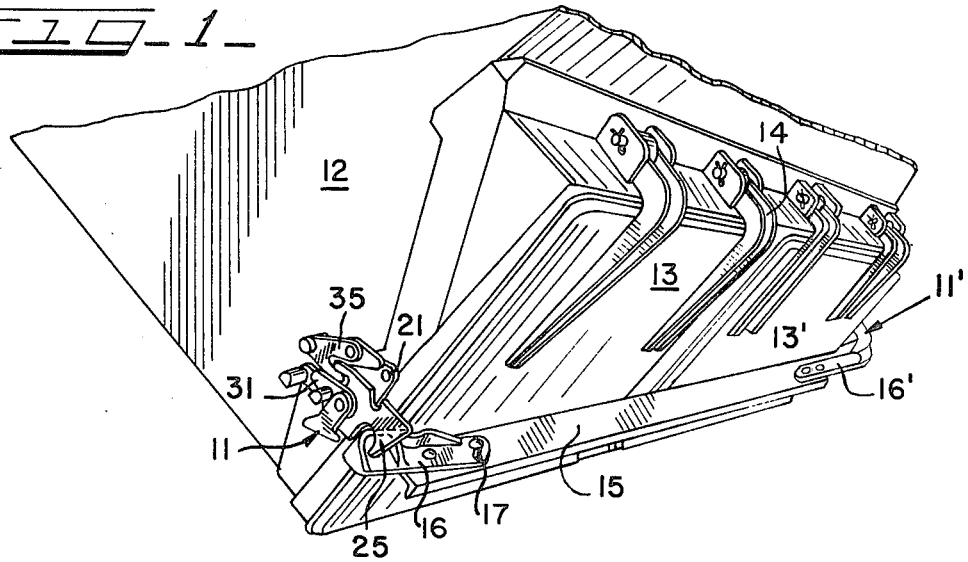
FIG. 1 is a perspective view of a preferred embodiment of the lock mechanism of this invention, shown mounted upon an outside hopper sheet of a railway hopper car.

FIG. 1 shows the lock mechanism, generally referred to by reference numeral 11, mounted on the outside hopper sheet 12 of a conventional railway car hopper having a door 13, pivotally mounted by means of hinges 14. A spreader bar 15, which is typically a rolled z-bar or a rolled channel, interconnects door 13 with its adjacent door 13'. Usually, another lock mechanism 11' will be mounted on the opposing outside hopper sheet of the hopper so that each lock mechanism 11 is accessible from its respective side of the railway car. A spreader extension 16, 16' generally will be provided at each end of spreader bar 15 so as to permit each mechanism 11 to be operatively interconnected with the spreader bar 15. Preferably, each spreader extension 16 is riveted or bolted to spreader bar 15 and then welded in place along an arcuate slot 17 to provide the desired alignment between the spreader extension 16 and the lock mechanism 11.

The details of the lock mechanism 11 can be readily understood from FIGS. 2–6, showing the three operating positions desired of the doors 13 of a railway hopper car. Mechanism 11 includes a housing 21 that is securely mounted to the outside hopper sheet 12, usually by means of rivets 22 or the like. Housing 21 has bores to receive a pivot pin 23 and has an inside shelf 24. A hook member 25 is mounted over housing 21 so that pivot pin 23 projects through a slot 26 within the hook member 25 such that the hook member 25 may slide or shift diagonally on housing 21 either generally up or down substantially along the slope A—A of the outside hopper sheet 12. In the position shown in FIGS. 2, 3, and 4, the hook member 25 is disposed down the slope A—A, in which condition the pivot pin 23 engages the slot 26 at its upper end, while in the fully closed position shown in FIG. 5, the hook member 25 is disposed up the slope A—A, in which condition the pivot pin 23 engages the slot 26 at its lower end. Hook member 25 also includes a laterally projecting hook member prying lug 27, a single hooking recess 28, and two generally oppositely facing stops, one being an outwardly positioned stop 29 and the other being an inwardly positioned stop 30.

A bifurcated pawl member 31 is also rotatably mounted by means of the pivot pin 23, pawl member 31 including a laterally projecting pawl member prying lug 32 and a stop engagement means 33 at its free or distal end. Pawl member 31 and hook member 25 are structured and mounted with respect to each other such that the stop engagement means 33 is able to abut against the outwardly positioned stop 29 when hook member 25 is disposed down the slope A—A and such that, when the hook member 25 is disposed up the slope A—A, the stop engagement means 33 is able to abut against the inwardly positioned stop 30 of hook member 25.

Pivotally mounted by means of a pivot member, such as pivot rivet 34 projecting from the housing 21, is a latch 35, which preferably includes a transverse rod 36, an inner projection 37, and an outer projection 38.

Figure 2:
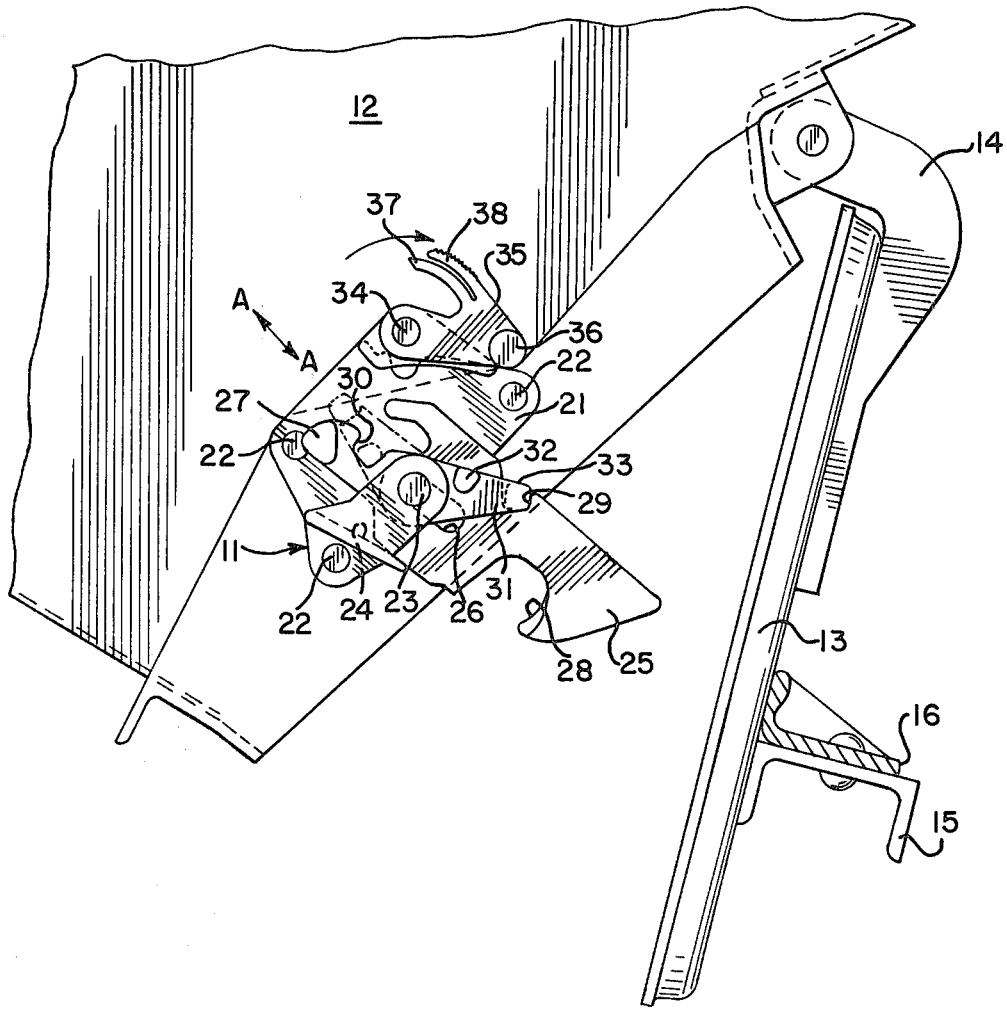
FIG. 2 is an enlarged fragmentary side elevational view of the lock mechanism of FIG. 1, shown with the door in its fully opened position.

In the fully opened position shown in FIG. 2, the lock mechanism 11 is completely disconnected from door 13, the latch member 35 is rotated out of engagement with the rest of lock mechanism 11, and the stop engagement means 33 of pawl member 31 is in contact with the outwardly positioned stop 29 of hook member 25 which is disposed down the slope A—A. By this arrangement, hook member 25 is free to rotate on pivot pin 23 since it is not constrained in any way by latch member 35. However, its movement is advantageously restricted by pawl member 31 such that, although hook member 25 can rotate on pivot pin 23, it cannot slide along its slot 26. While it is not essential that the stop engagement means 33 of pawl member 31 be engaged with the outwardly positioned stop 29 of hook member 25, such an engagement is preferred because of its advantageous restriction properties, whereby the hook member 25 rotates rather than slides when it comes into contact with the spreader extension 16 as the door 13 is moved toward the closed position and until it attains its "catch" position.

Figure 3:
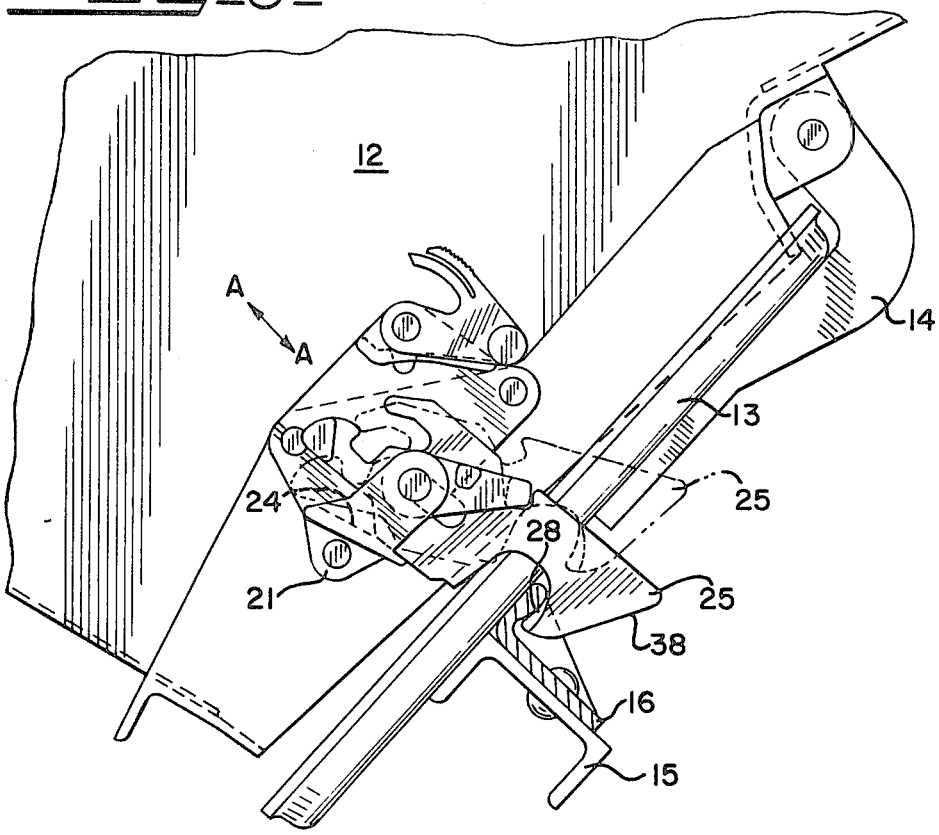
FIG. 3 is a side elevational view similar to FIG. 2 of the lock mechanism of FIG. 1, shown with the door in its "catch" position.

Referring more particularly to FIG. 3, this drawing illustrates the "catch" position wherein the hook recess 28 engages the spreader extension 16. In moving the hopper door 13 from the position shown in FIG. 2 to that shown in FIG. 3, a workman on each side of the hopper car pushes the door 13 toward its closed position in which condition the spreader extension 16 engages the leading edge 38 of hook member 25. Upon being so engaged by the spreader extension 16, the hook member 25 pivots generally upwardly as shown in phantom lines in FIG. 3 until the leading edge 38 rides over the spreader extension 16, and the hook member 25 drops down under its own weight, rotating generally downwardly, with the hook recess 28 engaging the spreader extension 16. When rotating upwardly in response to movement generated by contacting the spreader extension 16 with the leading edge 38 of hook member 25, the hook member 25 is restrained from excessive upward rotation by engaging the inside shelf 24 on housing 21.

Figure 4:
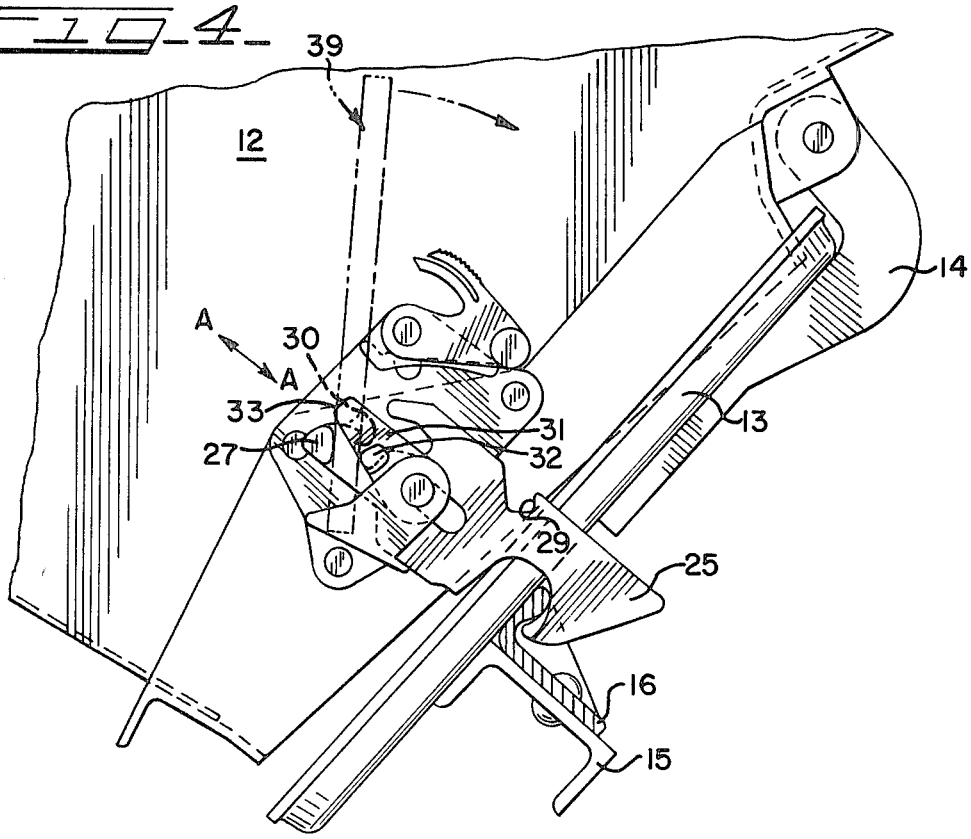
FIG. 4 is a side elevational view similar to FIG. 2 of the lock mechanism of FIG. 1, showing a pry bar in position to move the door from its "catch" position to its fully closed position.

Once the lock mechanism 11 is in the "catch" position shown in FIG. 3, the workman may proceed to fully close the door 13, which step is depicted in FIG. 4. The workman places one end of his pry bar 39 between the hook member prying lug 27 and the pawl member prying lug 32, and then pulls on the other end of the pry bar 39 to thereby move the hook member 25 from its disposition down the slope A—A to its disposition up the slope A—A. Preliminary to such an operation, the pawl member 31 has been taken out of engagement with the outwardly positioned stop 29 and rotated to a location where pawl member 31 rests near the inwardmost end of the hook member 25. The hook member 25 and the pawl member 31 are structured such that, as soon as the door 13 is moved to its fully closed position as shown in FIG. 5, the stop engagement means 33 of pawl member 31 drops down into engagement with the inwardly positioned stop 30 of the hook member 25, this dropping bringing with it a characteristic latching sound, making it possible for a workman to be certain of proper positioning even when he is working in the dark.

Figure 5:
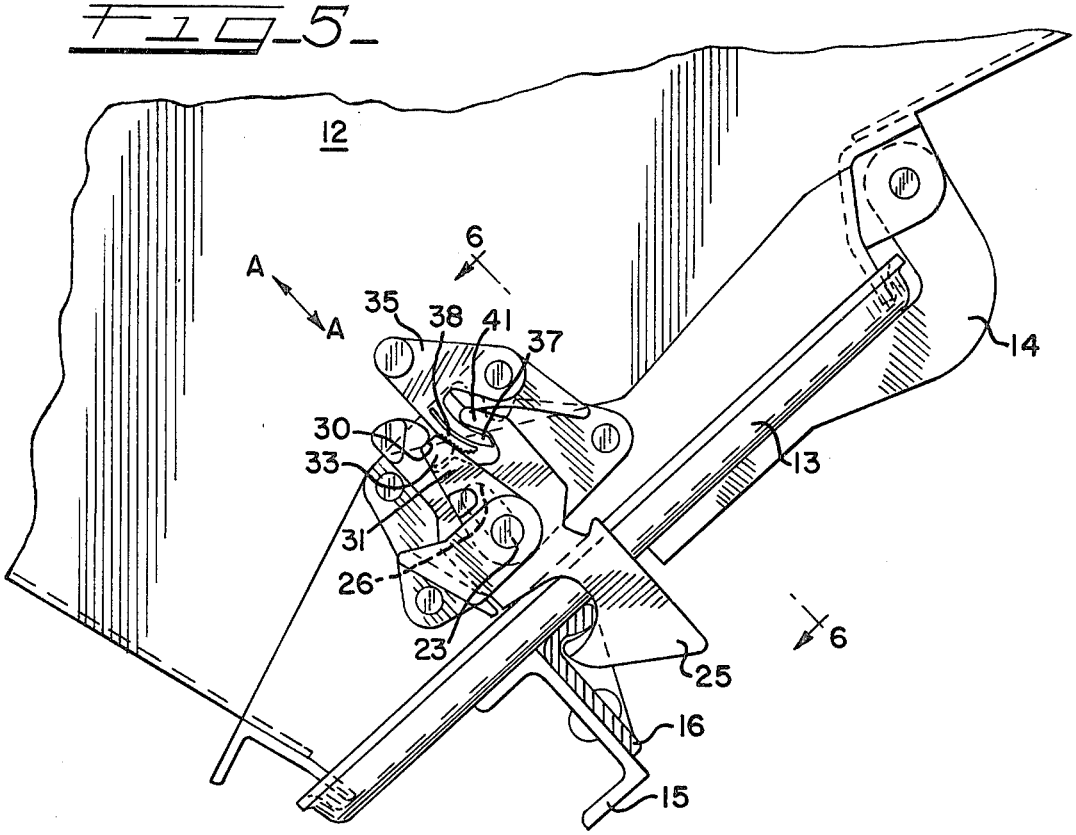
FIG. 5 is a side elevational view similar to FIG. 2 of the lock mechanism of FIG. 1, showing the door in its fully closed position.
Figure 6:
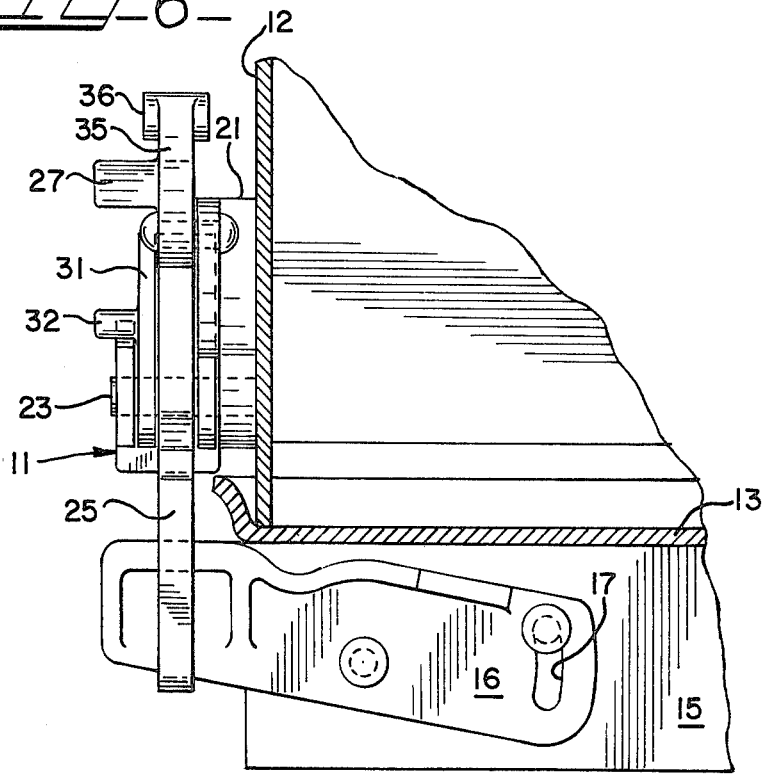
FIG. 6 is a detail sectional view taken on line 6—6 of FIG. 5.

FIG. 5 and FIG. 6 show the fully closed position of the lock member 11 wherein the latch 35 has been put into its full locking position by having been rotated counterclockwise until its inner projection 37 engages and holds the hook member 25 and locks the door 13 in its fully closed position. More particularly, the latch 35 is first rotated until its inner projection 37 is positioned under a hook extension 41 to ensure that the hook member 25 is down on the spreader extension 16 and that it stays in this position. Further rotation of the latch 35 forces the latch outer projection 38 down on top of the pawl member 31 to lock it also.

It should be noted that the latch 35 is mounted so that its own weight tends to keep it in the locked position when the railway car is upright on the rails. Additionally, the latch 35 is designed so there is a spring action built into its outer projection 38 to increase the amount of friction between outer projection 38 and the pawl member 31, thereby further ensuring that the latch 35 will stay in its locked position even when the railway car is turned over in a rotator. A further increase in this friction can be achieved by serrating or knurling the outside edge 42 (FIG. 7) of the outer projection 38 as shown in the drawings. Preferably, the latch 35 and the hook extension 41 are designed so that the rotation of the latch 35 stops when the projecting end of the inner projection 37 bears against the hook member 25 within its extension 41, whereby permanent damage to the spring-like outer projection 38 is prevented even should a workman hammer the latch 35 past its normal locking position.

From the preceding description, it is evident how the lock mechanism 11 cooperates with the spreader bar 15 in order to close adjacent doors of a railway hopper car by first pushing the door 13 to the "catch" position, and thereafter inserting pry bar 39 to move the structure to the fully closed position, followed by additional securement that may be provided by the latch 35, the spring action thereof being independent of gravitational forces to thereby hold the door in the fully closed position even when the railway car is rotated.

When the doors of a loaded hopper car are to be opened in order to have the contents thereof flow out of the underside of the car, the steps are generally reversed. The latch 35 is rotated out of engagement with the hook extension 41 with the aid of a pry bar 39, a hammer, or the like. Then, a pry bar 39 or a hammer may be used, with the assistance of hook member prying lug 27, to move the stop engagement means 33 of pawl member 31 out of engagement with the inwardly positioned stop 30 of hook member 25. This permits the hook member 25 to slide along its slot 26 until the door 13 swings to the "catch" position. The door 13 can then be moved to the fully opened position by continuing to either exert force on the hook member prying lug 27 or on the leading edge 38 of the hook member 25 until the spreader extension 16 is fully out of engagement with the hook recess 28 so that the spreader extension 16 fully clears the hook member 25, permitting the door 13 to swing or drop to its fully opened position. Alternatively, when one wishes to omit the "catch" position on opening the door 13, the workman simply exerts enough pressure on hook member 25, either downwardly onto its prying lug 27 or upwardly onto its leading edge 38 such that the spreader extension 16 is fully clear of the hook member 25.

Figures 7, 8:
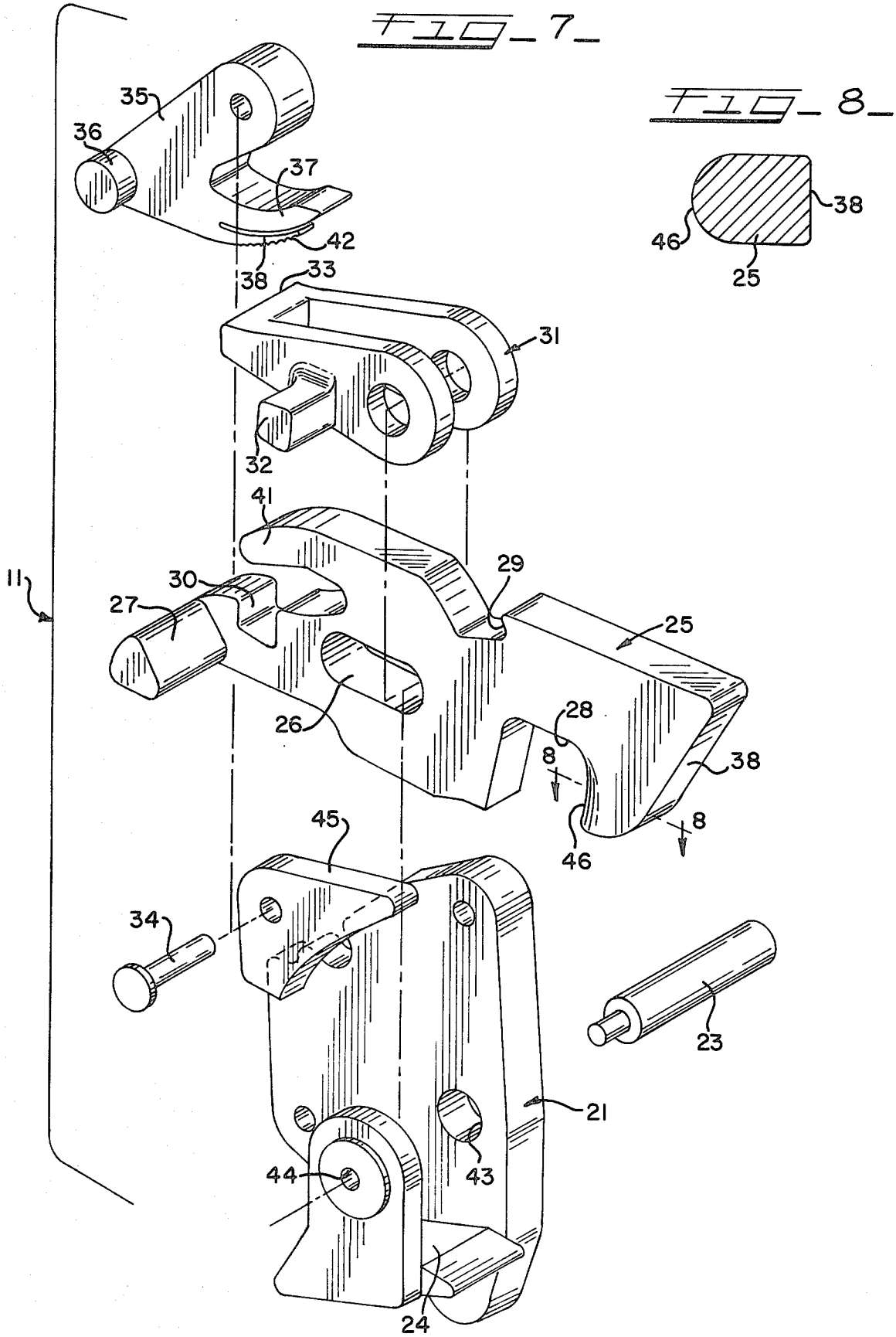
FIG. 7 is an exploded perspective view of the lock mechanism of FIG. 1.
FIG. 8 is a sectional view taken on line 8—8 of FIG. 7.

The exploded perspective (FIG. 7) most clearly shows the structure of the preferred lock mechanism 11, more particularly the housing 21, the hook member 25, the pawl member 31, and the latch 35. Also shown is the pivot pin 23, for rotatably mounting the hook member 25 and the pawl member 31 to the housing 21 through bores 43, 44. Pivot rivet 34 is shown positioned for mounting the latch 35 to a raised surface 45 of the housing 21. FIG. 8 depicts the preferred shape of the face 46 of the hooking recess 28 in the hook member 25.

It will be apparent to those skilled in this art that the present invention can be embodied in various forms of lock mechanisms and various arrangements thereof in conjunction with hopper doors and the like. Accordingly, this invention is to be construed and limited only by the scope of the appended claims.

I claim:

1. A hopper door lock mechanism comprising: a housing securely mounted to an outside hopper sheet; a laterally projecting pivot pin carried by said housing; a pawl member pivotally mounted on said pin; a hook member having a slot through which said pin projects, said hook member being pivotally and slidably mounted by said pivot pin along a slope on said outside hopper sheet and onto said housing through said slot; said housing having an inside shelf for restraining the pivoting of said hook member, thereby orienting the slope direction; said pawl member being pivotally mounted by said pivot pin onto said housing; said hook member having a hook formation on one end; said slot of the hook member having an upper end and a lower end; said hook member being positioned down said slope when said pivot pin engages said upper end of said slot; and said hook member being positioned up said slope when said pivot pin engages said lower end of said slot.

2. The lock mechanism of claim 1, wherein said hook member has an outwardly positioned stop and an inwardly positioned stop, said pawl member has a stop engagement means forengaging said outwardly positioned stop of said hook member when said hook member is down said slope and for engaging said inwardly positioned stop when said hook member is up said slope.

3. The lock mechanism of claim 1, further comprising a hook member prying lug projecting from said hook member and a pawl member prying lug projecting from said pawl member.

4. The lock mechanism of claim 1, further comprising a raised surface of said housing; a pivot rivet; and a latch pivotably mounted to said raised surface by said pivot rivet for locking engagement with said pawl member.

5. The lock mechanism of claim 1, further comprising a raised surface of said housing; a latch pivotably mounted to said raised surface; said latch including an outer projection having spring action for providing a securement force onto said pawl member.

6. The lock mechanism of claim 5, wherein said outer projection has a friction increasing outside edge for engaging said pawl member.

7. In combination with a multiple door railway car hopper chute of the type wherein the multiple doors are joined by a spreader bar having a spreader extension member for operative interconnection with a hook member of a hopper door lock mechanism, said hook member being pivotable, and wherein said lock mechanism includes a pivot pin, a housing mounted onto an outside hopper sheet, and a pivotable latch, the improvement which comprises said hook member having a slot through which it is both pivotally and slidably mounted along a slope onto said housing; said housing having an inside shelf for restraining the pivoting of said hook member, thereby orienting the slope direction; a pawl member pivotally mounted with said hook member onto said housing; said slot of the hook member having an upper end and a lower end; said hook member being down said slope when said pivot pin engages said upper end of said slot; and said hook member being up said slope when said pivot pin engages said lower end of said slot.

8. The combination of claim 7, wherein said hook member has an outwardly positioned stop and an inwardly positioned stop, said pawl member has a stop engagement means for engaging said outwardly positioned stop of said hook member when said hook member is down said slope and for engaging said inwardly positioned stop when said hook member is up and said slope.

9. The combination of claim 7, further comprising a hook member prying lug projecting from said hook member and a pawl member prying lug projecting from said pawl member.

10. The combination of claim 7, further comprising a raised surface of said housing, said latch is pivotally mounted to said raised surface, and said latch includes an outer projection having spring action for providing a securement force to said pawl member.

11. Lock mechanism for a door to a hopper outlet, which door is hinged from above the outlet, comprising: a housing mountable on an outside hopper sheet, a pivot pin and a pivot rivet both projecting generally transversely from said housing, a hook member having a slot, a single hooking recess, an outwardly positioned stop, an inwardly positioned stop and a hook extension, said slot of the hook member engaging said pivot pin to rotatably and slidably mount said hook member to said housing in such a manner that it can slide to a generally up position and to a generally down position on said outside hopper sheet, said housing having an inside shelf for restraining the rotating of said hook member thereby orienting the sliding to the generally up position and to the generally down position, a spreader extension securely fastened to a hopper door for operatively connecting said hook member to the hopper door, a pawl member rotatably mounted to said housing through said pivot pin, said pawl member having a free end and a stop engaging means thereat, said stop engaging means abutting against said outwardly positioned stop of said hook member when said hook member is in said generally down position and said stop engaging means abutting against said inwardly positioned stop of said hook member when said hook member is in said generally up position, a latch pivotally mounted to said housing through said pivot rivet, said latch having a projection so that when said latch is pivoted said projection can engage both said hook member under its hook extension and also said free end of said pawl member when said stop engaging means of said pawl member abuts against said inwardly positioned stop of said hook member.

* * * * *

UNITED STATES PATENT AND TRADEMARK OFFICE

CERTIFICATE OF CORRECTION

PATENT NO. : 4,184,432

DATED : January 22, 1980

INVENTOR(S) : Franklin P. Adler

It is certified that error appears in the above-identified patent and that said Letters Patent are hereby corrected as shown below:

In the abstract -- Line 8, "slaping" should be --sloping--

In Column 6, line 19, "forengaging" should be --for engaging--

Signed and Sealed this

*Fifteenth* Day of *April 1980*

[SEAL]

*Attest:*

SIDNEY A. DIAMOND

*Attesting Officer*

*Commissioner of Patents and Trademarks*